US010500634B2

(12) United States Patent
Volks et al.

(10) Patent No.: US 10,500,634 B2
(45) Date of Patent: Dec. 10, 2019

(54) FEEDER SYSTEM

(71) Applicant: FOSECO INTERNATIONAL LIMITED, Derbyshire (GB)

(72) Inventors: Christof Volks, Velen (DE); Harun Öztürk, Istanbul (TR)

(73) Assignee: FOSECO INTERNATIONAL LIMITED, Derbyshire (GB)

( * ) Notice: Subject to any disclaimer, the term of this patent is extended or adjusted under 35 U.S.C. 154(b) by 0 days.

(21) Appl. No.: 16/010,682

(22) Filed: Jun. 18, 2018

(65) Prior Publication Data

US 2018/0290203 A1 Oct. 11, 2018

Related U.S. Application Data

(63) Continuation of application No. 15/323,557, filed as application No. PCT/GB2015/052530 on Sep. 2, 2015, now Pat. No. 10,022,783.

(51) Int. Cl.
*B22C 9/08* (2006.01)
*B22C 9/02* (2006.01)

(52) U.S. Cl.
CPC ..... *B22C 9/088* (2013.01); *B22C 9/02* (2013.01); *B22C 9/084* (2013.01)

(58) Field of Classification Search
CPC ..... B22C 9/02; B22C 9/084; B22C 9/088
See application file for complete search history.

(56) References Cited

U.S. PATENT DOCUMENTS

| | | | |
|---|---|---|---|
| 5,915,450 | A | 6/1999 | Aufderheide et al. |
| 6,904,952 | B2 | 6/2005 | Skerdi et al. |
| 9,968,993 | B2 | 5/2018 | Volks |
| 2005/0236132 | A1 | 10/2005 | Powell et al. |

(Continued)

FOREIGN PATENT DOCUMENTS

| | | | |
|---|---|---|---|
| CN | 203281811 | U | 11/2013 |
| CN | 203541446 | U | 4/2014 |

(Continued)

OTHER PUBLICATIONS

Search Report dated Jan. 22, 2015 in Great Britain Application No. 1415516.2, 3 pages.

(Continued)

*Primary Examiner* — Kevin P Kerns
*Assistant Examiner* — Steven S Ha
(74) *Attorney, Agent, or Firm* — Nixon & Vanderhye PC

(57) ABSTRACT

A feeder system for metal casting comprising a feeder sleeve mounted on a tubular body.

The tubular body has a first end and an opposite second end and a compressible portion therebetween so that upon application of a force in use, the distance between the first and second ends is reduced.

The feeder sleeve has a longitudinal axis and comprises a continuous sidewall extending generally around the longitudinal axis that defines a cavity for receiving liquid metal during casting, the sidewall having a base adjacent the second end of the tubular body. The tubular body defines an open bore therethrough for connecting the cavity to the casting.

The feeder sleeve has at least one cut-out that extends into the sidewall from the base and the second end of the tubular body projects into the cut-out to a fixed depth.

The cut-out can be a groove which is separate from the cavity.

The invention also resides in a process employing the feeder system.

21 Claims, 5 Drawing Sheets

(56) References Cited

U.S. PATENT DOCUMENTS

| | | | |
|---|---|---|---|
| 2008/0223543 | A1 | 9/2008 | Skerdi |
| 2008/0230201 | A1 | 9/2008 | Skerdi |
| 2008/0265129 | A1 | 10/2008 | Skerdi |
| 2009/0301684 | A1 | 12/2009 | Beckmann et al. |
| 2015/0283602 | A1 | 10/2015 | Schafer |
| 2017/0182547 | A1 | 6/2017 | Volks et al. |

FOREIGN PATENT DOCUMENTS

| | | |
|---|---|---|
| DE | 2334501 | 3/1975 |
| DE | 295 10 068 | 10/1996 |
| DE | 201 12 425 | 10/2001 |
| DE | 20 2004 021109 | 10/2006 |
| DE | 10 2007 012117 | 9/2008 |
| DE | 10 2008 009730 | 8/2009 |
| DE | 202011050109 U1 | 9/2012 |
| DE | 20 2013 102133 | 5/2013 |
| DE | 20 2013 102 133 | 7/2013 |
| DE | 20 2013 001 933 | 6/2014 |
| EA | 14660 | 12/2010 |
| EP | 0265112 | 4/1988 |
| EP | 1 184 104 | 3/2002 |
| EP | 1775045 | 4/2007 |
| GB | 1597832 | 9/1981 |
| GB | 2141649 | 1/1985 |
| JP | 63-101042 | 5/1988 |
| JP | 2004-532737 | 10/2004 |
| JP | 2007-509760 | 4/2007 |
| JP | 2008-531287 | 8/2008 |
| JP | 2009-006401 | 1/2009 |
| JP | 2009-539612 | 11/2009 |
| JP | 2010-510071 | 4/2010 |
| SU | 83278 | 10/1950 |
| WO | 97/01406 | 1/1997 |
| WO | 2005/051568 | 6/2005 |
| WO | 2005/095020 | 10/2005 |
| WO | 2007/141446 | 12/2007 |
| WO | 2012/110753 | 8/2012 |
| WO | 2013/171439 | 11/2013 |
| WO | 2014/083155 | 6/2014 |

OTHER PUBLICATIONS

Search Report dated Dec. 7, 2015 in International Application No. PCT/GB2015/052528, 13 pages.

Search Report dated May 30, 2016 in International Application No. PCT/GB2015/052529, 11 pages.

International Preliminary Report on Patentability dated Mar. 15, 2018 in corresponding International Application No. PCT/GB2015/052530, 10 pages.

"Foseco Feedex K Sleeves Improve Productivity and Process Control", Foundry Trade Journal, vol. 179, No. 3624. May 1, 2005,pp. 99.

Fischer et al., "Die Entwicklung Leistungsstarker Speisungshilfsmittel zur Steigemng der Gussqualitat", Giesserei, vol. 100, No. 8, Aug. 1, 2013, pp. 54-61.

International Search Report for PCT/GB2015/052530, dated Jun. 10, 2016, 4 pages.

Written Opinion of the ISA for PCT/GB2015/052530, dated Jun. 10, 2016, 6 pages.

Office Action dated Jul. 25, 2018 in related Russian Application No. 2017103294/02(005717), 7 pages.

Office Action dated Aug. 27, 2018 in related Russian Application No. 2017103294/02(005717) (with translation), 10 pages.

Office Action dated Oct. 16, 2018 in related Japanese Application No. 2017-512301 (with partial translation), 4 pages.

Office Action dated Oct. 16, 2018 in related Japanese Application No. 2017-512309 (with partial translation), 7 pages.

Office Action dated May 28, 2019 in related Japanese Application No. 2018-511636, 5 pages.

Office Action dated Mar. 28, 2019 in related Chinese Application No. 201580082849.0 (with translation), 13 pages.

FEEDER SYSTEM

CROSS-REFERENCE TO RELATED APPLICATIONS

This application is a continuation of application Ser. No. 15/323,557 filed Jan. 3, 2017, which is a National Phase of International Application No. PCT/GB2015/052530 filed Sep. 2, 2015, the entire contents of each of which are hereby incorporated by reference in this application.

TECHNICAL FIELD

The present invention relates to a feeder system for use in metal casting operations utilising casting moulds, a feeder sleeve for use in the feeder system and a process for preparing a mould comprising the feeder system.

BACKGROUND AND SUMMARY

In a typical casting process, molten metal is poured into a pre-formed mould cavity which defines the shape of the casting. However, as the metal solidifies it shrinks, resulting in shrinkage cavities which in turn result in unacceptable imperfections in the final casting. This is a well known problem in the casting industry and is addressed by the use of feeder sleeves or risers which are integrated into the mould, either during mould formation by applying them to a pattern plate, or later by inserting a sleeve into a cavity in the formed mould. Each feeder sleeve provides an additional (usually enclosed) volume or cavity which is in communication with the mould cavity, so that molten metal also enters into the feeder sleeve. During solidification, molten metal within the feeder sleeve flows back into the mould cavity to compensate for the shrinkage of the casting.

After solidification of the casting and removal of the mould material, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity) in a design commonly referred to as a neck down sleeve. When a sharp blow is applied to the residual metal it separates at the weakest point which will be near to the mould (the process commonly known as "knock off"). A small footprint on the casting is also desirable to allow the positioning of feeder sleeves in areas of the casting where access may be restricted by adjacent features.

Although feeder sleeves may be applied directly onto the surface of the casting mould cavity, they are often used in conjunction with a feeder element (also known as a breaker core). A breaker core is simply a disc of refractory material (typically a resin bonded sand core or a ceramic core or a core of feeder sleeve material) with a hole usually in its centre which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the casting surface.

Moulding sand can be classified into two main categories. Chemical bonded (based on either organic or inorganic binders) or clay-bonded. Chemically bonded moulding binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting.

Clay-bonded moulding uses clay and water as the binder and can be used in the "green" or undried state and is commonly referred to as greensand. Greensand mixtures do not flow readily or move easily under compression forces alone and therefore to compact the greensand around the pattern and give the mould sufficient strength properties as detailed previously, a variety of combinations of jolting, vibrating, squeezing and ramming are applied to produce uniform strength moulds at high productivity. The sand is typically compressed (compacted) at high pressure, usually using one or more hydraulic rams.

To apply sleeves in such high pressure moulding processes, pins are usually provided on the moulding pattern plate (which defines the mould cavity) at predetermined locations as mounting points for the feeder sleeves. Once the required sleeves are placed on the pins (such that the base of the feeder is either on or raised above the pattern plate), the mould is formed by pouring moulding sand onto the pattern plate and around the feeder sleeves until the feeder sleeves are covered and the mould box is filled. The application of the moulding sand and subsequent high pressures may cause damage and breakage of the feeder sleeve, especially if the feeder sleeve is in direct contact with the pattern plate prior to ram up, and with increasing casting complexity and productivity requirements, there is a need for more dimensionally stable moulds and consequently, a tendency towards higher ramming pressures and resulting sleeve breakages.

The Applicant has developed a range of collapsible feeder elements for use in combination with feeder sleeves, which are described in WO2005/051568, WO2007141446, WO2012110753 and WO2013171439. The feeder elements compress when subjected to pressure during moulding, thereby protecting the feeder sleeve from damage.

US2008/0265129 describes a feeder insert for inserting into a casting mould used for casting metals, comprising a feeder body having a feeder cavity therein. The bottom side of the feeder body is in communication with the casting mould and the top side of the feeder body is provided with an energy absorbing device.

EP1184104A1 (Chemex GmbH) describes a two-part feeder sleeve (which can be either insulating or exothermic) which telescopes when the moulding sand is compressed; the internal wall of the second (upper) part is flush with the external wall of the first (lower) part.

EP1184104A1 FIGS. 3*a* to 3*d* illustrate the telescoping action of the two-part feeder sleeve (102). The feeder sleeve (102) is in direct contact with the pattern (122), which can be detrimental when an exothermic sleeve is employed since it can result in a poor surface finish, localised contamination of the casting surface and even sub-surface casting defects. In addition, even though the lower part (104) is tapered, there is still a wide foot-print on the pattern (122) since the lower part (104) must be relatively thick to withstand the forces experienced during ram-up. This is unsatisfactory in terms of knock-off and the space taken up by the feeder system on the pattern. The lower inner part (104) and the upper outer part (106) are held in position by retaining elements (112). The retaining elements (112) break off and fall into the moulding sand (150) to allow the telescoping action to take place. The retaining elements will build up in the moulding sand over time and thereby contaminate it. This is particularly troublesome where the retaining elements are made from exothermic material since they may react creating small explosive defects.

U.S. Pat. No. 6,904,952 (AS Luengen GmbH & Co. KG) describes a feeder system where a tubular body is temporarily glued to the inner wall of a feeder sleeve. There is relative movement between the feeder sleeve and the tubular body when the moulding sand is compressed.

Increasing demands are being placed on feeding systems for use in high pressure moulding systems, partly due to advances in moulding equipment, and partly due to new castings being produced. Certain grades of ductile iron and particular casting configurations may adversely influence the effectiveness of feed performance through the neck of certain metal feeder elements. Additionally, certain moulding lines or casting configurations may result in over compression (collapsing of the feeder element or telescoping of the feeder system) resulting in the base of the sleeve being in close proximity to the casting surface separated by only a thin layer of sand. The present invention provides a feeder system for use in metal casting seeks to overcome one or more problems associated with prior art feeder systems or to provide a useful alternative.

According to a first aspect of the present invention there is provided a feeder system for metal casting comprising a feeder sleeve mounted on a tubular body;

the tubular body having a first end and an opposite second end and a compressible portion therebetween so that upon application of a force in use, the distance between the first and second ends is reduced;

the feeder sleeve having a longitudinal axis and comprising a continuous sidewall extending generally around the longitudinal axis that defines a cavity for receiving liquid metal during casting, the sidewall having a base adjacent the second end of the tubular body;

the tubular body defining an open bore therethrough for connecting the cavity to the casting, wherein at least one cut-out extends into the sidewall from the base, and the second end of the tubular body projects into the cut-out to a fixed depth.

In use the feeder system is mounted on a mould pattern, typically placed over a moulding pin attached to the pattern plate to hold the system in place, such that the tubular body is next to the mould. The open bore defined by the tubular body provides a passage from the feeder sleeve cavity to the mould cavity to feed the casting as it cools and shrinks. During moulding and subsequent ram-up, the feeder system will experience a force in the direction of the longitudinal axis of the tubular body (the bore axis). As the second end of the tubular body is retained at a fixed depth within the cut-out of the feeder sleeve, this force causes the compressible portion to collapse, there being no possibility of relative movement between the tubular body and the sleeve. Hence, the high compression pressure causes deformation of the tubular body rather than breakage of the feeder sleeve. Typically the feeder system will experience a ram up pressure (as measured at the pattern plate) of at least 30, 60, 90, 120 or 150 N/cm$^2$.

WO2005/051568 FIG. 3 shows a feeder system comprising a compressible breaker core (10, which is a tubular body) and a feeder sleeve (20). The breaker core comprises a radial sidewall region, which it is attached to the base of the feeder sleeve by means of adhesive. WO2005/095020 FIG. 1 shows a feeder system comprising a first moulded body (4, which is a tubular body) and a second moulded body (5, which is a feeder sleeve). The first moulded body (4) comprises a deformation element which is in the form of bellows and is connected to the base of the feeder sleeve by an annular support surface. In the present invention the tubular body fits within a cut-out in a feeder sleeve rather than being attached to the base of a feeder sleeve.

When a metal breaker core (collapsible or tubular telescoping) is used, the metal, which is usually steel, is heated up on casting and takes a certain amount of energy out of the liquid metal within the feeder. Metal breaker cores commonly have an annular mounting surface, therefore reducing the size or totally eliminating this reduces the amount of (cold) metal in the breaker core allowing the core to be heated quicker with less energy taken from the metal feeder. Furthermore, by partly embedding the breaker core in an exothermic sleeve, it will receive additional energy and be superheated, which in turns will improve the feed performance through the neck of the core.

Tubular Body

The tubular body serves two functions: (i) the tubular body has an open bore therethrough which provides a passage from the feeder sleeve cavity to the casting mould and (ii) the deformation of the tubular body (due to the collapsible portion) serves to absorb energy that could otherwise cause breakage of the feeder sleeve.

The tubular body comprises a compressible portion. In one embodiment the compressible portion has a stepped configuration. A stepped configuration is known from WO2005/051568. In one embodiment the compressible portion comprises a single step or "kink". In another embodiment the compressible portion comprises at least 2, 3, 4, 5 or 6 steps or kinks. In one such embodiment the compressible portion comprises from 4 to 6 steps or kinks.

The diameter of the step(s) or kink(s) can be measured. In one embodiment all of the steps have the same diameter. In another embodiment the diameter of the steps decreases towards the first end of the tubular body. i.e. the compressible portion is frustoconical.

The angle $\mu$ of the taper between the frustoconical shaped compressible portion and the bore axis/feeder sleeve longitudinal axis can be measured. In one series of embodiments the frustoconical portion is inclined from the axis at an angle of no more than 50, 40, 30, 20, 15 or 10°. In one series of embodiments the frustoconical portion is inclined from the axis at an angle of at least 3, 5, 10 or 15°. In one embodiment the angle $\mu$ is from 5 to 20°. A slight taper can be beneficial for providing even compression.

The stepped configuration may comprise an alternating series of first and second sidewall regions and the angle formed between a pair of the first and second sidewall regions can be measured. The internal angle ($\theta$) is measured from within the tubular body and the external angle ($\phi$) is measured from outside the tubular body. It will be understood that the angles $\theta$ and $\phi$ will decrease on ram-up as the compressible portion collapses. In one series of embodiments the angle between a pair of first and second sidewall regions is at least 30, 40, 50, 60 or 70°. In one series of embodiments the angle between a pair of first and second sidewall regions is no more than 120, 100, 90, 80, 70, 60 or 50°. In one embodiment the angle between a pair of first and second sidewall regions is from to 60 to 90°.

The stepped configuration may comprise an alternating series of first and second sidewall regions and the angle $\alpha$ formed between the first sidewall region(s) and the longitudinal axis of the tubular body (the bore axis) can be measured. Similarly the angle $\beta$ formed between the second sidewall region(s) and the bore axis can be measured.

In one embodiment the angles $\alpha$ and $\beta$ are the same.

In one embodiment $\alpha$ and $\beta$ is approximately 90° i.e. the first sidewall regions or the second sidewall regions are approximately perpendicular to the bore axis.

In one embodiment α and β is approximately 0 i.e. the first sidewall regions or the second sidewall regions are approximately parallel to the bore axis.

In one embodiment each of α and β is from 40 to 70°, from 30 to 60° or from 35° to 55°.

The height of the tubular body can be measured in a direction parallel to the bore axis and may be compared to the height of the compressible portion (also measured in a direction parallel to the bore axis). In one series of embodiments the height of the compressible portion corresponds to at least 20, 30, 40 or 50% of the height of the tubular body. In another series of embodiments the height of the compressible portion corresponds to no more than 90, 80, 70 or 60% of the height of the tubular body.

The size and mass of the tubular body will depend on the application.

It is generally preferable to reduce the mass of the tubular body when possible. This reduces material costs and can also be beneficial during casting, e.g. by reducing the heat capacity of the tubular body. In one embodiment the tubular body has a mass of less than 50, 40, 30, 25 or 20 g.

It will be understood that the tubular body has a longitudinal axis, the bore axis. In general the feeder sleeve and the tubular body will be shaped such that the bore axis and the feeder sleeve longitudinal axis are the same. However, this is not essential.

The height of the tubular body may be measured in a direction parallel to the bore axis and may be compared to depth of the cut-out (the first depth). In some embodiments the ratio of the height of the tubular body to the first depth is from 1:1 to 5:1, from 1.1:1 to 3:1 or from 1.3:1 to 2:1.

The tubular body has an inner diameter and an outer diameter and a thickness which is the difference between the inner and outer diameters (all measured in a plane perpendicular to the bore axis). The thickness of the tubular body must be such that it allows the tubular body to project into the cut-out. In some embodiments the thickness of the tubular body is at least 0.1, 0.3, 0.5, 0.8, 1, 2 or 3 mm. In some embodiments the thickness of the tubular body is no more than 5, 3, 2, 1.5, 1, 0.8 or 0.5 mm. In one embodiment the tubular body has a thickness of from 0.3 to 1.5 mm. A small thickness is beneficial for a number of reasons including, reducing the material required to manufacture the tubular body and allowing the corresponding cut-out in the sidewall to be narrow, and reducing the heat capacity of the tubular body and hence the amount of energy absorbed from the feeder metal on casting. The cut-out extends from the base of the sidewall and the wider the cut-out, the wider the base must be to accommodate it.

In one embodiment the tubular body has a circular cross-section. However, the cross-section could be non-circular e.g. oval, obround or elliptical. In one preferred embodiment the tubular body narrows (tapers) in a direction away from the feeder sleeve (next to the casting in use). A narrow portion adjacent the casting is known as a feeder neck and provides better knock off of the feeder. In one series of embodiments, the angle of the tapered neck relative to the bore axis shall be no more than 55, 50, 45, 40 or 35°.

To further improve knock off, the base of the tubular body may have an inwardly directed lip to provide a surface for mounting on the mould pattern and produce a notch in the resulting cast feeder neck to facilitate its removal (knock off).

The tubular body can be manufactured from a variety of suitable materials including metal (e.g. steel, iron, aluminium, aluminium alloys, brass, copper etc.) or plastics. In a particular embodiment, the tubular body is made from metal. A metal tubular body can be made to have a small thickness whilst retaining sufficient strength to withstand moulding pressures. In one embodiment the tubular body is not manufactured from feeder sleeve material (whether insulating or exothermic). Feeder sleeve material is not generally strong enough to withstand moulding pressures at small thickness, whereas a thicker tubular body requires a wider groove in the sidewall and therefore increases the size (and associated cost) of the feeder system as a whole. Additionally, a tubular body comprising feeder sleeve material may also cause poor surface finish and defects where it is in contact with the casting.

In certain embodiments where the tubular body is formed from metal, it may be press-formed from a single metal piece of constant thickness. In one embodiment the tubular body is manufactured via a drawing process, whereby a metal sheet blank is radially drawn into a forming die by the mechanical action of a punch. The process is considered deep drawing when the depth of the drawn part exceeds its diameter and is achieved by redrawing the part through a series of dies. In another embodiment, the tubular body is manufactured via a metal spinning or spin forming process, whereby a blank disc or tube of metal is first mounted on a spinning lathe and rotated at high speed. Localised pressure is then applied in a series of roller or tool passes that causes the metal to flow down onto and around a mandrel that has the internal dimensional profile of the required finished part.

To be suitable for press-forming or spin-forming, the metal should be sufficiently malleable to prevent tearing or cracking during the forming process. In certain embodiments the feeder element is manufactured from cold-rolled steels, with typical carbon contents ranging from a minimum of 0.02% (Grade DC06, European Standard EN10130—1999) to a maximum of 0.12% (Grade DC01, European Standard EN10130—1999). In one embodiment the tubular body is made from steel having a carbon content of less than 0.05, 0.04 or 0.03%.

Feeder Sleeve

In one embodiment the cut-out is a groove that extends from the base of the sidewall. It will be understood that the groove in the sidewall is separate from the feeder sleeve cavity. In one embodiment the groove is located at least 5, 8 or 10 mm from the feeder sleeve cavity.

In another embodiment the cut-out is contiguous with the feeder sleeve cavity. In one such embodiment the end of the cut-out is defined by a ledge in the sidewall.

The cut-out can be considered to have a first depth, which is the distance by which the cut-out extends away from the base into the sidewall. Typically, the cut-out has a uniform depth i.e. the distance from the base into the sidewall is the same no matter where it is measured. However, a cut-out of variable depth could be employed if desired and the first depth will be understood to be the minimum depth, since this dictates the extent to which the tubular body can project into the cut-out.

Before ram-up, the tubular body is received in the cut-out to a second depth; the tubular body at least partially projects into the cut-out. In one embodiment the tubular body fully projects into the cut-out i.e. the second depth is equal to the first depth.

In one embodiment the compressible portion of the tubular body is spaced from the cut-out. Alternatively the compressible portion of the tubular body projects partly or fully into the cut-out in the feeder sleeve (prior to ram-up). The size and shape of the compressible portion will affect the location of the compressible portion. It is more practical for the compressible portion to be located outside the feeder sleeve to allow even and consistent collapsing and minimise any particles of sleeve being abraded by movement of the compression portion against the sleeve.

The cut-out must be capable of receiving the tubular body. Hence the cross-section of the cut-out (in a plane perpendicular to the bore axis) corresponds to the cross-section of the tubular body e.g. the groove is a circular groove and the tubular body has a circular cross-section. In one embodiment the at least one cut-out is a single, continuous groove. In another embodiment the feeder sleeve has a series of slots and the tubular body has a corresponding shape e.g. a castellated edge.

In one series of embodiments the cut-out has a first depth of at least 20, 30, 40 or 50 mm. In one series of embodiments the first depth is no more than 100, 80, 60 or 40 mm. In one embodiment the first depth is from 25 to 50 mm. The first depth can be compared to the height of the feeder sleeve. In one embodiment, the first depth corresponds to from 10 to 50% or 20 to 40% of the height of the feeder sleeve.

The cut-out is considered to have a maximum width (W), which is measured in a direction approximately perpendicular to the bore axis and/or the feeder sleeve axis. It will be understood that the width of the cut-out must be sufficient to allow the tubular body to be received inside the cut-out. In one series of embodiments the cut-out has a width of at least 0.5, 1, 2, 3, 5, 8 or 10 mm. In one series of embodiments the cut-out has a maximum width of no more than 15, 10, 5, 3 or 1.5 mm. In one embodiment the cut-out has a maximum width of from 1 to 3 mm. This is particularly useful when the cut-out is a groove (separate from the cavity). In one embodiment the cut-out has a maximum width of from 5 to 10 mm. This is particularly useful when the cut-out is contiguous with the cavity.

The cut-out may have a uniform width i.e. the width of the cut-out is the same no matter where it is measured. Alternatively, the cut-out may have a non-uniform width. For example, when the cut-out is a groove, it may narrow away from the base of the sidewall.

Hence, the maximum width is measured at the base of the sidewall and the width then reduces to a minimum value at the first depth.

In one series of embodiments the second depth (D2, the depth to which the tubular body is received in the cut-out) is at least 30, 40 or 50% of the first depth. In one series of embodiments the second depth is no more than 90, 80, or 70% of the first depth. In one embodiment the second depth is from 80 to 100% of the first depth.

Typically, the tubular body projects into the cut-out to a uniform depth i.e. the distance from the base to the end of tubular body is the same no matter where it is measured. However, a tubular body having an uneven edge (e.g. a castellated edge) could be employed if desired such that the distance would vary and the second depth will be understood to be the maximum depth, save that there can be no gap between the tubular body and the base of the sidewall to avoid ingress of moulding sand into the casting.

The nature of the feeder sleeve material is not particularly limited and it may be for example insulating or exothermic. An exothermic feeder sleeve generates heat, which helps keep the molten metal liquid for longer. Exothermic sleeves may be fast igniting highly exothermic high density sleeves such as the FEEDEX® range of products sold by Foseco, or exothermic-insulating sleeves such as the KALMINEX® range of products sold by Foseco that are have a notably lower density and are less exothermic than the FEEDEX range of sleeves.

In one embodiment the feeder sleeve is an exothermic feeder sleeve. As discussed above, the present invention avoids any potential chilling having an adverse effect on feed performance by embedding part of the tubular body inside the feeder sleeve and by reducing the total amount of (cold) metal in the tubular body (breaker core) by not using a mounting surface which projects outside the feeder sleeve cavity. This benefit is more noticeable when using an exothermic sleeve rather than an insulating sleeve, as this is believed to assist in superheating the metal tubular body (breaker core).

The mode of manufacture is not particularly limited, the sleeve may be manufactured for example using either the vacuum-forming process or core-shot method. Typically a feeder sleeve is made from a mixture of low and high density refractory fillers (e.g. silica sand, olivine, alumino-silicate hollow microspheres and fibres, chamotte, alumina, pumice, perlite, vermiculite) and binders. An exothermic sleeve further requires a fuel (usually aluminium or aluminium alloy), an oxidant (typically iron oxide, manganese dioxide, or potassium nitrate) and usually initiators/sensitisers (typically cryolite).

In one embodiment a conventional feeder sleeve is manufactured and then feeder sleeve material is removed from the base to form the cut-out e.g. by drilling or grinding. In another embodiment the feeder sleeve is manufactured with the cut-out in place, typically by a core-shooting method incorporating a tool that defines the cut-out e.g. the tool has a thin mandrel around which the sleeve is formed, after which the sleeve is removed (stripped) from the tool and mandrel. In a further embodiment the sleeve is formed around the tubular body.

In one series of embodiments the feeder sleeve has a strength (crush strength) of at least 8 kN, 12 kN, 15 kN, 20 kN or 25 kN. In one series of embodiments, the sleeve strength is less than 25 kN, 20 kN, 18 kN, 15 kN, or 10 kN. For ease of comparison the strength of a feeder sleeve is defined as the compressive strength of a 50×50 mm cylindrical test body made from the feeder sleeve material. A 201/70 EM compressive testing machine (Form & Test Seidner, Germany) is used and operated in accordance with the manufacturer's instructions. The test body is placed centrally on the lower of the steel plates and loaded to destruction as the lower plate is moved towards the upper plate at a rate of 20 mm/minute. The effective strength of the feeder sleeve will not only be dependent upon the exact composition, binder used and manufacturing method, but also on the size and design of the sleeve, which is illustrated by the fact that the strength of a test body is usually higher than that measured for a standard flat topped sleeve.

In one series of embodiments the feeder sleeve has a density of at least 0.5, 0.8, 1.0 or 1.3 g/cm$^3$. In another series of embodiments the feeder sleeve has a density of no more than 2.0, 1.5 or 1.2 g/cm$^3$. KALMIN S® is a commercially available sleeve having a typical density of 0.45 g/cm$^3$; this sleeve is insulating. Low density exothermic-insulating feeder sleeves are available under the brand name KALMINEX® and typically have densities of from 0.58 to 0.95 g/cm$^3$. FEEDEX HD® is a commercially available high density highly exothermic sleeve having a density of 1.4 g/cm$^3$. It is generally found that increasing the density of a sleeve by adjusting the types of refractory fillers and other components, typically results in an increase in strength.

Parameters that can be considered when evaluating an exothermic feeder sleeve include ignition time, the maximum temperature achieved (Tmax), the duration of the exothermic reaction (burn time), and Modulus Extension Factor (MEF, extension of solidification time by a factor of x).

In one embodiment the feeder sleeve has a MEF of at least 1.40, 1.55 or 1.60. KALMINEX 2000® feeder sleeves are exothermic-insulating sleeves and typically have an MEF of 1.58 to 1.64, whereas FEEDEX® sleeves are exothermic and typically have an MEF of 1.6 to 1.7 respectively. KALMIN S® feeder sleeves are insulating and typically have an MEF of 1.4 to 1.5.

In one embodiment the feeder sleeve comprises a roof spaced from the base of the sidewall. The sidewall and roof together define the cavity for receiving liquid metal during casting. In one such embodiment the roof and the sidewall are integrally formed. Alternatively, the sidewall and the roof are separable i.e. the roof is a lid. In one embodiment both the sidewall and the roof are made from feeder sleeve material.

Feeder sleeves are available in a number of shapes including cylinders, ovals and domes. As such, the sidewall may be parallel to or angled from the feeder sleeve longitudinal axis. The roof (if present) may be flat topped, domed, flat topped dome, or any other suitable shape.

The roof of the sleeve may be closed so that the feeder sleeve cavity is enclosed, and it may also contain a recess (a blind bore) extending partially through the top section of the feeder (opposite the base) to assist in mounting the feeder system on a moulding pin attached to the mould pattern. Alternatively, the feeder sleeve may have an aperture (an open bore) that extends through the whole of the feeder roof so that the feeder cavity is open. The aperture must be wide enough to accommodate a support pin but narrow enough to avoid sand entering the feeder sleeve cavity during moulding. The diameter of the aperture may be compared to the maximum diameter of the feeder sleeve cavity (both measured in a plane perpendicular to the longitudinal axis of the feeder sleeve). In one embodiment the diameter of the aperture is no more than 40, 30, 20, 15 or 10% of the maximum diameter of the feeder sleeve cavity.

In use, the feeder system is typically placed on a support pin to hold the feeder system in the required position on the mould pattern plate prior to the sand being compressed and rammed up. On ram up, the sleeve moves towards the mould pattern surface and the pin, if fixed, may puncture the roof of the feeder sleeve, or it simply may traverse through the aperture or recess as the sleeve moves downwards. This movement and contact of the roof with the pin may cause small fragments of sleeve to break off and fall into the casting cavity, resulting in poor casting surface finish or localised contamination of the casting surface. This may be overcome by lining the aperture or recess in the roof with a hollow insert or internal collar, which may be manufactured from a variety of suitable materials including metal, plastic or ceramic. Thus, in one embodiment, the feeder sleeve may be modified to include an internal collar lining the aperture or recess in the roof of the feeder. This collar may be inserted into the aperture or recess in the sleeve roof after the sleeve has been produced, or alternatively, is incorporated during manufacture of the sleeve, whereby sleeve material is core-shot or moulded around the collar, after which the sleeve is cured and holds the collar in place. Such a collar protects the sleeve from any damage that might be caused by the support pin during moulding and ram up.

The invention also resides in a feeder sleeve for use in the feeder system according to embodiments of the first aspect.

According to a second aspect of the present invention there is provided a feeder sleeve for use in metal casting, the feeder sleeve having a longitudinal axis and comprising a continuous sidewall extending generally around the longitudinal axis and a roof extending generally across the longitudinal axis, the sidewall and roof together defining a cavity for receiving liquid metal during casting, wherein the sidewall has a base spaced from the roof and a groove extends from the base into the sidewall.

The comments above in relation to the first aspect also apply to the second aspect with the exception that the feeder sleeve of the second aspect must comprise a roof. It will be understood that that the groove extends away from the base and towards the roof.

In one embodiment an aperture (an open bore) extends through the feeder roof. In one such embodiment an internal collar lines the aperture. This embodiment is useful when the feeder sleeve is employed with a support pin as described above.

In one embodiment the roof is closed i.e. no aperture extends through the feeder roof.

According to a third aspect of the present invention there is provided a process for preparing a mould comprising placing the feeder system of the first aspect on a pattern, the feeder system comprising a feeder sleeve mounted on a tubular body;

the feeder sleeve comprising a continuous sidewall that defines a cavity for receiving liquid metal during casting, the sidewall having a base adjacent the tubular body;

the tubular body defining an open bore therethrough for connecting the cavity to the casting, the tubular body having a first end and an opposite second end and a compressible portion therebetween, wherein a cut-out extends into the sidewall from the base and the second end of the tubular body projects into the cut-out to a fixed depth;

surrounding the pattern with mould material;

compacting the mould material; and removing the pattern from the compacted mould material to form the mould;

wherein compacting the mould material comprises applying pressure to the feeder system such that the compressible portion is compressed and the distance between the first and second ends is reduced.

The mould could be a horizontally parted or a vertically parted mould. If used in a vertically parted moulding machine (such as Disamatic flaskless moulding machines manufactured by DISA Industries A/S) the feeder system is typically placed on the swing (pattern) plate when in the horizontal position during the normal mould making cycle. The sleeves may be placed on the horizontal pattern or swing plate manually or automatically by the use of robots.

The comments above in relation to the first and second aspects also apply to the third aspect. In particular, in one embodiment the cut-out is a groove (separate from the cavity). In another embodiment the cut-out is contiguous with the casting.

In one series of embodiments compacting the mould material comprises applying a ram up pressure (as measured at the pattern plate) of at least 30, 60, 90, 120 or 150 $N/cm^2$.

In one embodiment the compressible portion has a stepped configuration. In one such embodiment the stepped configuration comprises an alternating series of first and second sidewall regions and compression of the compressible portion reduces the angle between a pair of first and second sidewall regions.

In one embodiment the mould material is clay bonded sand (usually referred to as greensand), which typically comprises a mixture of clay such as sodium or calcium bentonite, water and other additives such as coal dust and cereal binder. Alternatively the mould material is mould sand containing a binder.

BRIEF DESCRIPTION OF THE DRAWINGS

Embodiments of the invention will now be described by way of example only with reference to the accompanying drawings in which:—

DETAILED DESCRIPTION

Figure 1B:
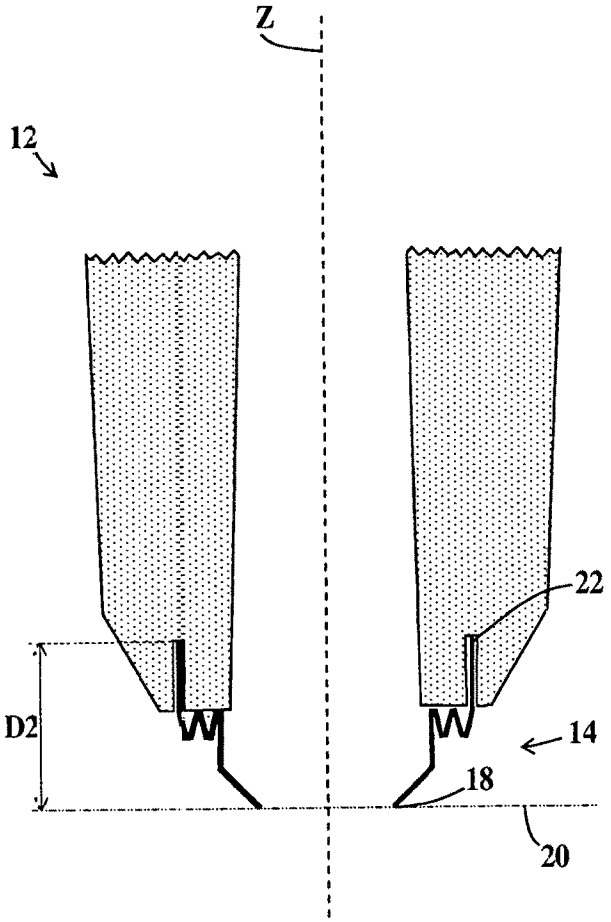
FIGS. 1*a* to 5 are schematic diagrams showing feeder systems in accordance with embodiments of the invention.
Figure 1A:
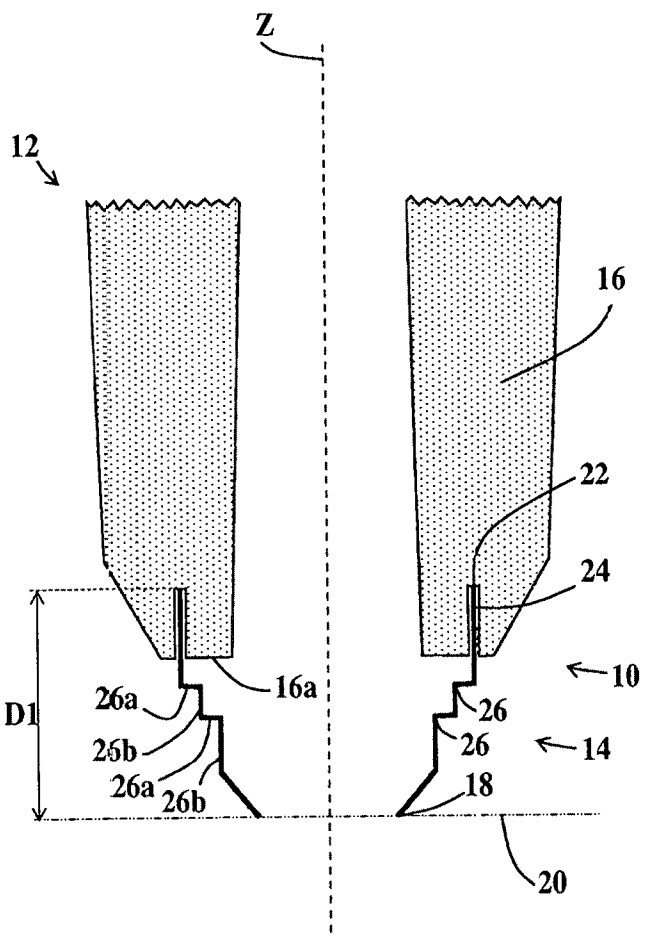

Referring to FIG. 1*a* there is shown a feeder system 10 before compression. The feeder system comprises an exothermic feeder sleeve 12 mounted on a tubular body 14. The feeder sleeve 12 has a longitudinal axis Z and a continuous sidewall 16 extends generally radially around the axis to define a cavity for receiving molten metal during casting. The upper part of the feeder sleeve 12 is not shown.

The tubular body 14 tapers inwardly at a first end 18 to form a feeder neck in contact with a pattern plate 20. The tubular body 14 has a second end 22 that projects into a groove 24 that extends from the base 16*a* of the sidewall 16. The groove 24 is separate from the cavity. The second end 22 and the groove 24 are sized and shaped to provide a friction fit, which secures the tubular body 14 in place at a fixed depth.

The tubular body 14 defines an open bore therethrough for connecting the cavity to the casting in use. In this example the bore axis lies along the longitudinal axis Z.

The tubular body 14 comprises two steps 26 between the first end 18 and the second end 22, which constitute a compressible portion. The steps 26 can be considered to be an alternating series of first sidewall regions 26*a* and second sidewall regions 26*b*. The first sidewall regions 26*a* are perpendicular to the bore axis Z and the second sidewall regions 26*b* are parallel to the bore axis Z. The angle between a pair of the first 26*a* and second sidewall regions 26*b* is 90°. The diameter of the first and second sidewall regions decreases in a direction away from the feeder sleeve, the compressible portion can be considered to be frustoconical. The distance between the first and second ends 18, 22 of the tubular body 14 is shown as D1.

Referring to FIG. 1*b* there is shown the feeder system 10 after compression. The application of a force along the axis Z during ram-up causes the tubular body 14 to collapse thereby reducing the distance between the first end 18 and the second end 22 to D2. The feeder sleeve 12 moves closer to the pattern 20 on ram-up.

Figure 2B:
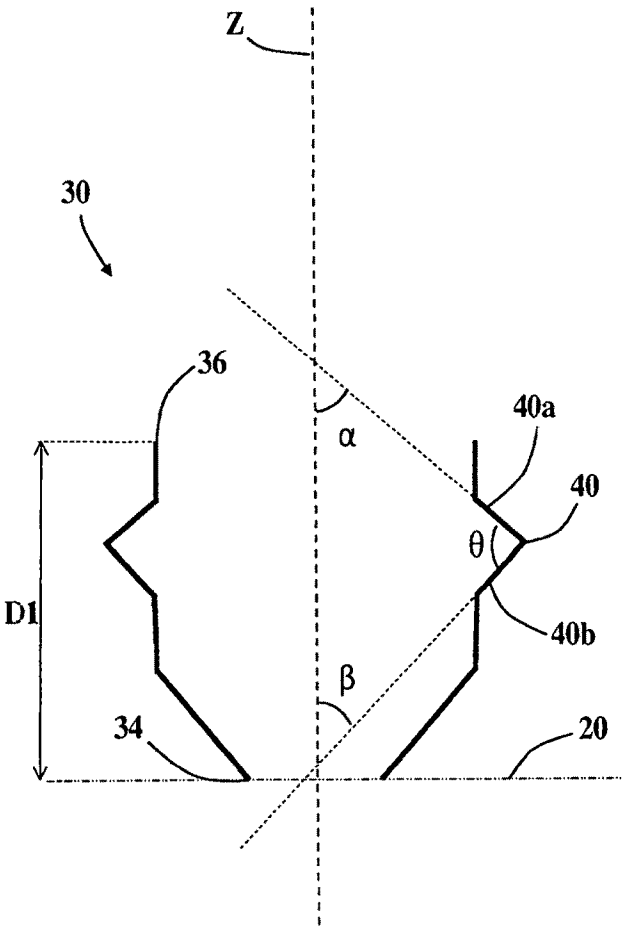
Figure 2A:
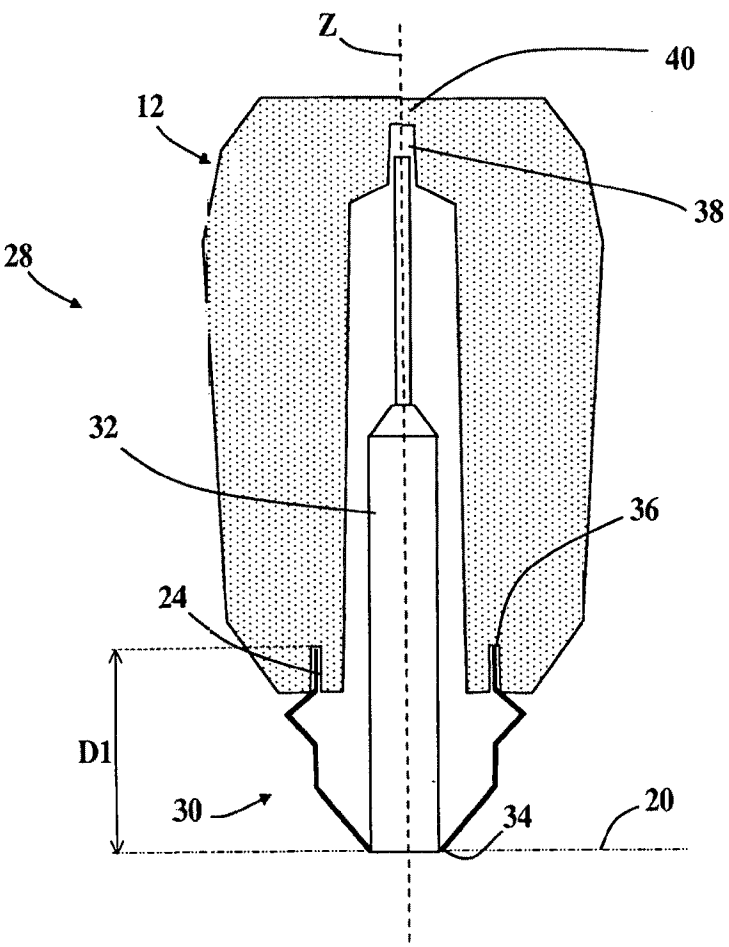

Referring to FIG. 2*a* there is shown a feeder system 28 before compression. The feeder system comprises the exothermic feeder sleeve 12 mounted on a tubular body 30 and a support pin 32. The tubular body 30 tapers inwardly at a first end 34 to form a feeder neck in contact with the pattern plate 20. The tubular body 30 has a second end 36 that projects into the groove 24.

The top of a moulding pin 32 is located in a complementary recess 38 in the roof 40 of the sleeve 12, and on ram up, as the sleeve 12 moves downwards, the top of the moulding pin 32 pierces the thin section at the top of the roof 40. If desired a collar could be fitted in the recess 38 to avoid the risk of fragments of sleeve breaking off when the pin 32 punctures the roof 40. Alternatively a narrow aperture could extend through the roof 40 in place of the recess 38 and thereby accommodate the support pin 32. In this case the aperture would have a diameter corresponding to approximately 15% of the maximum diameter of the feeder sleeve cavity.

The tubular body 30 is shown without the feeder sleeve in FIG. 2*b*. The tubular body 30 comprises a single outward kink 40 between the first end 34 and the second end 36, which constitutes a compressible portion. The kink 40 is formed by a first sidewall region 40*a* and second sidewall region 40*b*. The first sidewall region 40*a* makes an angle $\alpha$ with the longitudinal axis Z and the second sidewall region 40*b* make an angle $\beta$ with the longitudinal axis Z. The angles $\alpha$ and $\beta$ are the same (both approximately 50°)-. The angle $\theta$ formed between the first and second sidewall regions 40*a*,40*b* is approximately 80°. It will be understood that $\alpha+\beta+\theta=180°$.

On ram-up a force will be applied in the direction of the axis Z causing the tubular body to collapse thereby reducing the distance D1 between the first and second ends 34, 36 and reducing the angle $\theta$.

Figure 3B:
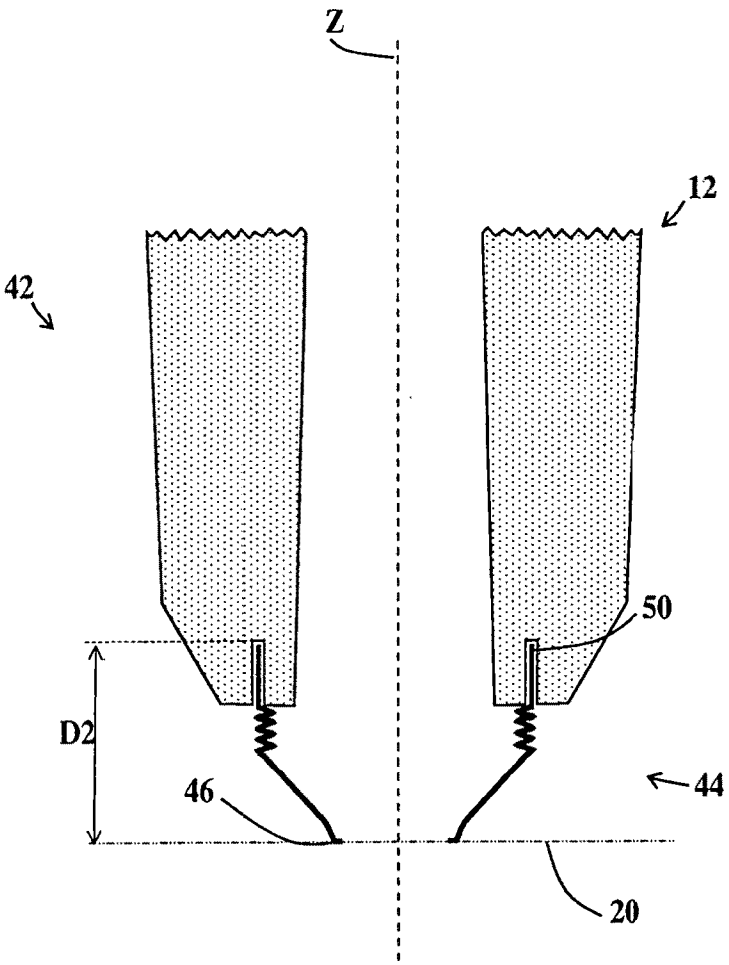
Figure 3A:
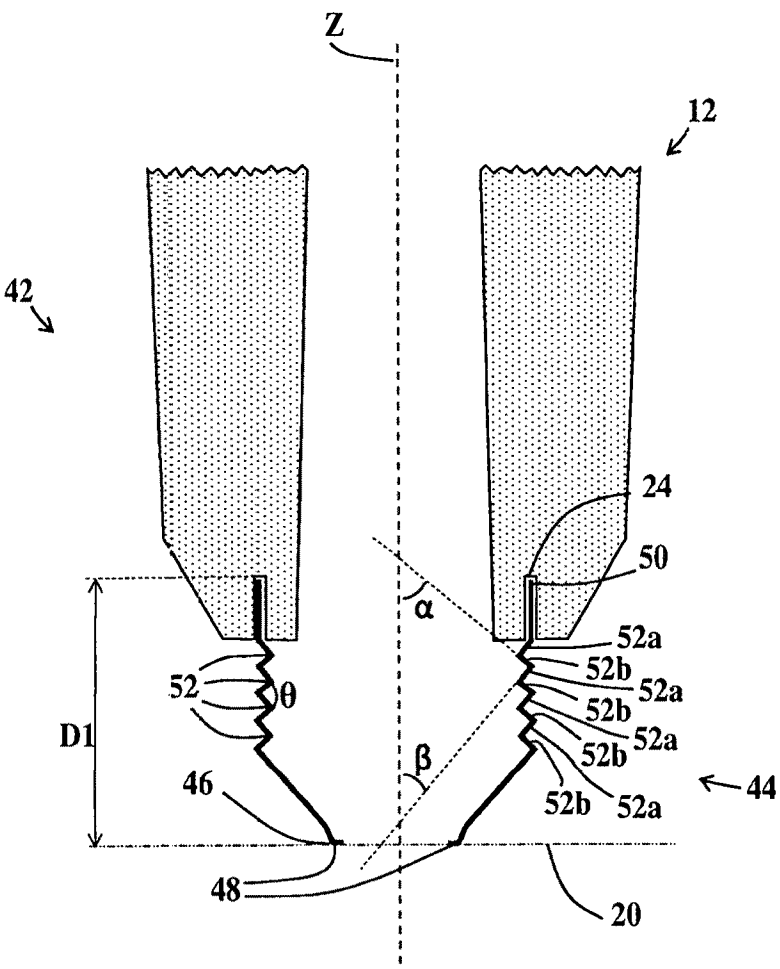

Referring to FIG. 3*a* there is shown a feeder system 42 before compression. The feeder system 42 comprises the exothermic feeder sleeve 12 mounted on a tubular body 44. The tubular body 42 tapers at a first end 46 to form a feeder neck in contact with the pattern plate 20. The tubular body 42 has an inwardly directed lip or flange 48 at its base that sits on the surface of the pattern plate 20 in use, and produces a notch in the resulting metal feeder neck to facilitate its removal (knock off). The tubular body 42 has a second end 50 that projects into the groove 24 to the full depth of the groove 24. It will be understood that a tapered groove could be employed whereby the tubular body is unable to project fully to the end of the groove where the groove becomes too narrow.

The tubular body 44 comprises four inward kinks 52 between the first end 46 and the second end 50, which constitute a compressible portion. The kinks 52 are formed by an alternating series of first sidewall regions 52*a* and second sidewall regions 52*b*. The first sidewall regions 52*a* make an angle $\alpha$ with the longitudinal axis Z and the second sidewall regions 52*b* make an angle $\beta$ with the longitudinal axis Z. The angles $\alpha$ and $\beta$ are the same (both approximately 50°). The use of two or more kinks 52 can be considered to provide a bellows-type construction. The internal angle $\theta$ formed between a pair of the first and second sidewall regions 52*a*, 52*b* is approximately 80°. It will be understood that $\alpha+\beta+\theta=180°$.

Referring to FIG. 3*b* there is shown the feeder system 42 after compression. The application of a force along the axis Z during ram-up causes the tubular body 44' to collapse thereby reducing the distance between the first end 46 and the second end 50 to D2. The feeder sleeve 12 moves closer to the pattern 20 on ram-up.

Figure 4B:
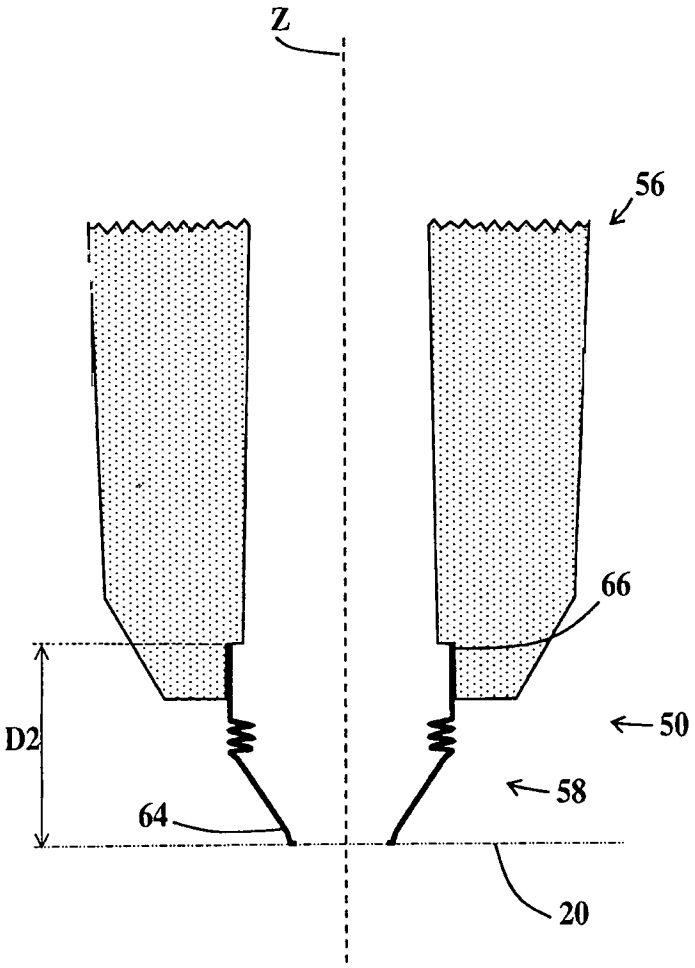
Figure 4A:
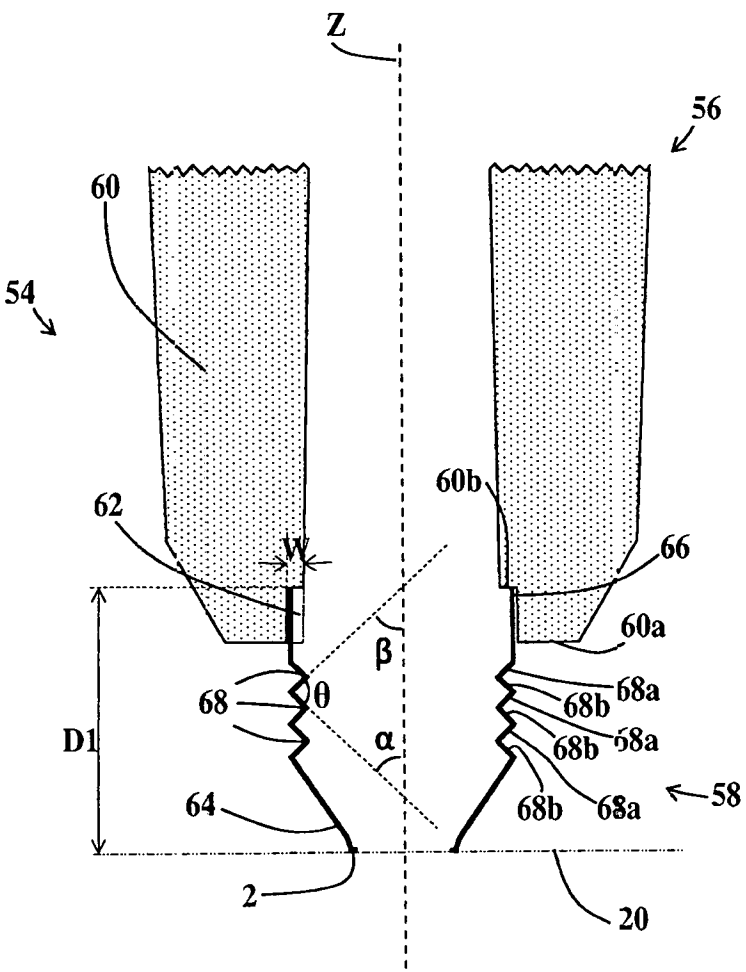

Referring to FIG. 4*a* there is shown a feeder system 54 before compression. The feeder system comprises an exothermic feeder sleeve 56 mounted on a tubular body 58. The feeder sleeve 56 has a longitudinal axis Z and a continuous sidewall 60 extends generally radially around the axis to define a cavity for receiving molten metal during casting. The continuous sidewall 60 has a base 60*a* from which a cut-out 62 extends. The end of the cut-out 62 is defined by a ledge 60*b* in the sidewall 60. The cut-out 62 has a width W measured in a direction perpendicular to the bore axis Z.

The tubular body 58 tapers inwardly at a first end 64 to form a feeder neck in contact with the pattern plate 20. The tubular body 58 has a second end 66 that projects into the cut-out 62 and abuts the ledge 60*b*. The tubular body 58 and the cut-out 62 are sized and shaped so that the tubular body

58 fits snugly against the sidewall 60. The tubular body 58 defines an open bore therethrough for connecting the cavity to the casting in use. In this example the bore axis lies along the longitudinal axis Z.

The tubular body 58 comprises three inward kinks 68 between the first end 64 and the second end 66 which together constitute a bellows-like compressible portion. The kinks 68 are an alternating series of first sidewall regions 68*a* and second sidewall regions 68*b*. Each of the first sidewall regions 68*a* make an angle α with the longitudinal axis Z and each of the second sidewall regions 68*b* make an angle β with the longitudinal axis Z. The angles α and β are the same (both approximately 50°). The internal angle θ formed between a pair of the first and second sidewall regions 68*a*, 68*b* is approximately 80°. It will be understood that α+β+θ=180°.

FIG. 4*b* shows the feeder system 54 after compression. The tubular body 58 collapses reducing the distance from the first end 64 to the second end 66 to D2. The kinks are compressed reducing the angle θ to approximately 5°.

Figure 5:
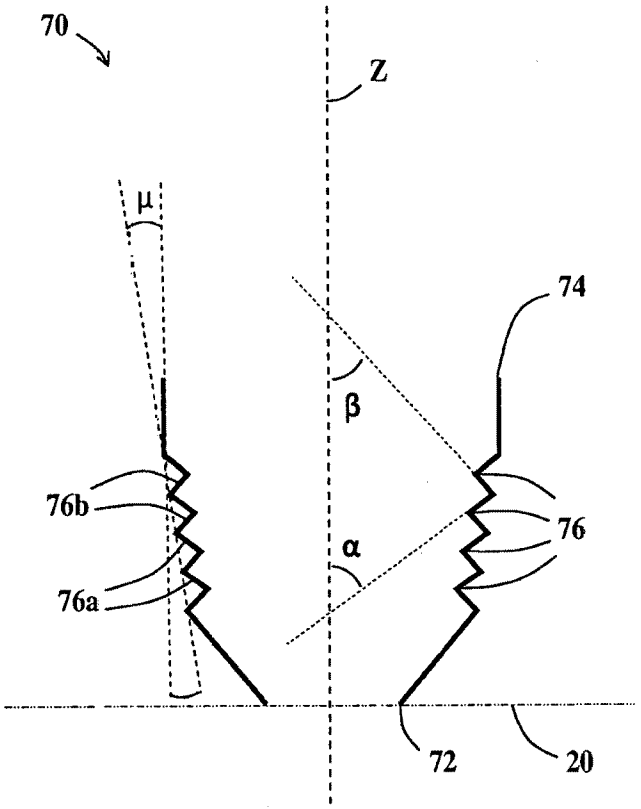

FIG. 5 shows a tubular body 70 for use in combination with a feeder sleeve such as feeder sleeve 12 (FIG. 1) or feeder sleeve 56 (FIG. 4). The tubular body 70 has a first end 72 and a second end 74 and defines an open bore therethrough. The bore has a longitudinal axis Z (the bore axis). The tubular body has a compressible portion that consists of 4 inward kinks 76 having an alternating series of first 76*a* and second 76*b* sidewall regions. The compressible portion is frustoconical, the diameter of the kinks 76 decreases slightly from the second end 74 to the second end 72 i.e. the tubular body tapers inwards toward the pattern plate 20. The angle of the taper μ is less than 10° (measured with reference to the bore axis Z).

The first sidewall regions 76*a* make an internal angle α with the bore axis and the second sidewall regions 76*b* make an internal angle β with the bore axis. The angle α is slightly greater (approximately 60°) than the angle β (approximately 45°). The angle between the first and second sidewall regions is approximately 75° (whether measured inside or outside the tubular body).

Embodiments of the invention may be described by the following clauses:

1. A feeder system for metal casting comprising a feeder sleeve mounted on a tubular body;
the tubular body having a first end and an opposite second end and a compressible portion therebetween so that upon application of a force in use, the distance between the first and second ends is reduced;
the feeder sleeve having a longitudinal axis and comprising a continuous sidewall extending generally around the longitudinal axis that defines a cavity for receiving liquid metal during casting, the sidewall having a base adjacent the second end of the tubular body;
the tubular body defining an open bore therethrough for connecting the cavity to the casting, wherein
at least one cut-out extends into the sidewall from the base and the second end of the tubular body projects into the cut-out to a fixed depth.

2. The system of clause 1, wherein the compressible portion comprises a single step or kink constituted by first and second sidewall regions.

3. The system of clause 1, wherein the compressible portion comprises an alternating series of first and second sidewall regions thereby providing multiple steps/kinks.

4. The system of clause 3, wherein the alternating series of first and second sidewall regions together form four steps or kinks.

5. The system of any one of clauses 2 to 4, wherein (i) the angle θ formed between a pair of the first and second sidewall regions is from to 60 to 90°; (ii) the angle α formed between the first sidewall region(s) and the longitudinal axis of the tubular body is from 30 to 60°; and/or (iii) the angle β formed between the second sidewall region(s) and the longitudinal axis of the tubular body is from 30 to 60°.

6. The system of any one of clauses 3 to 5, wherein each of the steps/kinks has a diameter measured in a direction perpendicular to the longitudinal axis and all of the steps/kinks have the same diameter.

7. The system of any one of clauses 3 to 5, wherein each of the steps/kinks has a diameter measured in a direction perpendicular to the longitudinal axis and the diameter of the steps/kinks decreases towards the first end of the tubular body to form a frustoconical compressible portion.

8. The system of clause 7, wherein the frustoconical compressible portion is inclined from the longitudinal axis at an angle of no more than 15°.

9. The system of any one of the preceding clauses, wherein the tubular body is metal.

10. The system of clause 9 wherein the metal is steel having a carbon content of less than 0.05%

11. The system of any one of the preceding clauses, wherein the cut-out extends away from the base to a first depth and the tubular body projects into the cut-out to the first depth.

12. The system of any one of the preceding clauses wherein the cut-out extends away from the base to a first depth and the first depth corresponds to from 5 to 30% of the height of the feeder sleeve.

13. The system of any one of the preceding clauses, wherein the cut-out is a groove.

14. The system of any one of clauses 1 to 12, wherein the cut-out is contiguous with the feeder sleeve cavity.

15. The system of any one of the preceding clauses, wherein the compressible portion of the tubular body is spaced from the cut-out.

16. The system of any one of the preceding clauses, wherein the feeder sleeve is an exothermic feeder sleeve.

17. The system of any one of the preceding clauses, wherein the feeder sleeve has a crush strength of at least 25 kN.

18. A feeder sleeve for use in the feeder system of clause 1, the feeder sleeve having a longitudinal axis and comprising a continuous sidewall extending generally around the longitudinal axis and a roof extending generally across the longitudinal axis, the sidewall and roof together defining a cavity for receiving liquid metal during casting, wherein the sidewall has a base spaced from the roof and a groove extends from the base into the sidewall.

19. A process for preparing a mould comprising
placing a feeder system on a pattern plate, the feeder system comprising a feeder sleeve mounted on a tubular body;
the feeder sleeve comprising a continuous sidewall that defines a cavity for receiving liquid metal during casting, the sidewall having a base adjacent the tubular body;
the tubular body defining an open bore therethrough for connecting the cavity to the casting, the tubular body having a first end and an opposite second end and a compressible portion therebetween,
wherein a cut-out extends into the sidewall from the base and the second end of the tubular body projects into the cut-out to a fixed depth;
surrounding the pattern with mould material;
compacting the mould material; and removing the pattern from the compacted mould material to form the mould;

wherein compacting the mould material comprises applying pressure to the feeder system such that the compressible portion is compressed and the distance between the first and second ends is reduced.

20. The process of clause 19, wherein compacting the mould material comprises applying a ram up pressure of at least 30 $N/cm^2$.

21. The process of clause 19 or 20 wherein the compressible portion has a stepped configuration comprising an alternating series of first and second sidewall regions and compression of the compressible portion reduces the angle θ between a pair of first and second sidewall regions.

What is claimed is:

1. A feeder system for metal casting comprising a feeder sleeve mounted on a tubular body;

the tubular body having a first end and an opposite second end and a compressible portion therebetween so that upon application of a force in use, the distance between the first and second ends is reduced;

the feeder sleeve having a longitudinal axis and comprising a continuous sidewall extending generally around the longitudinal axis that defines a cavity for receiving liquid metal during casting, the sidewall having a base adjacent the second end of the tubular body;

the tubular body defining an open bore therethrough for connecting the cavity to the casting, wherein at least one cut-out extends into the sidewall from the base and the second end of the tubular body projects into the at least one cut-out to a fixed depth, and the feeder sleeve is supported by a portion of the tubular body that projects into the at least one cut-out and that is substantially parallel to the longitudinal axis of the feeder sleeve.

2. The system of claim 1, wherein the compressible portion consists of a single step or kink constituted by first and second sidewall regions.

3. The system of claim 2, wherein (i) the angle θ formed between a pair of the first and second sidewall regions is from to 60 to 90°; (ii) the angle α formed between the first sidewall region(s) and the longitudinal axis of the tubular body is from 30 to 60°; and/or (iii) the angle β formed between the second sidewall region(s) and the longitudinal axis of the tubular body is from 30 to 60°.

4. The system of claim 2, wherein the step or kink of the compressible portion of the tubular body is located outside of the feeder sleeve.

5. The system of claim 4, wherein the step or kink of the compressible portion of the tubular body is spaced from the at least one cut-out.

6. The system of claim 1, wherein the compressible portion consists of an alternating series of first and second sidewall regions thereby providing multiple steps or kinks.

7. The system of claim 6, wherein the alternating series of first and second sidewall regions together form four steps or kinks.

8. The system of claim 6, wherein each of the steps or kinks has a diameter measured in a direction perpendicular to the longitudinal axis and all of the steps or kinks have the same diameter.

9. The system of claim 6, wherein each of the steps or kinks has a diameter measured in a direction perpendicular to the longitudinal axis and the diameter of the steps or kinks decreases towards the first end of the tubular body to form a frustoconical compressible portion.

10. The system of claim 9, wherein the frustoconical compressible portion is inclined from the longitudinal axis at an angle of no more than 15°.

11. The system of claim 6, wherein all of the steps or kinks of the compressible portion of the tubular body are located outside of the feeder sleeve.

12. The system of claim 6, wherein the compressible portion of the tubular body projects partly into the at least one cut-out in the feeder sleeve.

13. The system of claim 1, wherein the tubular body is metal.

14. The system claim 1, wherein the at least one cut-out extends away from the base to a first depth and the tubular body projects into the at least one cut-out to the first depth.

15. The system of claim 1, wherein the at least one cut-out is a groove.

16. The system of claim 1, wherein the at least one cut-out is contiguous with the feeder sleeve cavity.

17. The system of claim 1, wherein the feeder sleeve is an exothermic feeder sleeve.

18. The system of claim 1, wherein the feeder sleeve has a crush strength of at least 25 kN.

19. A feeder system for metal casting comprising a feeder sleeve mounted on a tubular body;

the tubular body having a first end and an opposite second end and a compressible portion therebetween so that upon application of a force in use, the distance between the first and second ends is reduced;

the feeder sleeve having a longitudinal axis and comprising a continuous sidewall extending generally around the longitudinal axis that defines a cavity for receiving liquid metal during casting, the sidewall having a base adjacent the second end of the tubular body;

the tubular body defining an open bore therethrough for connecting the cavity to the casting, wherein at least one cut-out extends into the sidewall from the base and the second end of the tubular body projects into the at least one cut-out to a fixed depth, and wherein a portion of the tubular body between the second end and the compressible portion projects into the at least one cut-out and is substantially parallel to the longitudinal axis of the feeder sleeve.

20. A process for preparing a mould comprising placing a feeder system on a pattern plate, the feeder system comprising a feeder sleeve mounted on a tubular body;

the feeder sleeve comprising a continuous sidewall that defines a cavity for receiving liquid metal during casting, the sidewall having a base adjacent the tubular body;

the tubular body defining an open bore therethrough for connecting the cavity to the casting, the tubular body having a first end and an opposite second end and a compressible portion therebetween, wherein a cut-out extends into the sidewall from the base and the second end of the tubular body projects into the cut-out to a fixed depth;

surrounding the pattern with mould material;

compacting the mould material; and removing the pattern from the compacted mould material to form the mould;

wherein compacting the mould material comprises applying pressure to the feeder system such that the compressible portion is compressed and the distance between the first and second ends is reduced; and wherein the feeder sleeve is supported by a portion of the tubular body that projects into the cut-out and that is substantially parallel to the longitudinal axis of the feeder sleeve.

21. The process of claim 20, wherein the compacting the mould material comprises applying a ram up pressure of at least 30 $N/cm^2$.

* * * * *